US009260956B2

(12) United States Patent
DuPree et al.

(10) Patent No.: US 9,260,956 B2
(45) Date of Patent: Feb. 16, 2016

(54) CONTINUOUS MULTI-STAGE WELL STIMULATION SYSTEM

(71) Applicant: Schlumberger Technology Corporation, Sugar Land, TX (US)

(72) Inventors: Wade D. DuPree, Sugar Land, TX (US); Pierre-Arnaud Foucher, Houston, TX (US); Ruben Martinez, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 249 days.

(21) Appl. No.: 13/908,202

(22) Filed: Jun. 3, 2013

(65) Prior Publication Data

US 2013/0319669 A1 Dec. 5, 2013

Related U.S. Application Data

(60) Provisional application No. 61/655,126, filed on Jun. 4, 2012, provisional application No. 61/709,642, filed on Oct. 4, 2012.

(51) Int. Cl.

| | |
|---|---|
| ***E21B 43/26*** | (2006.01) |
| ***E21B 34/14*** | (2006.01) |
| *E21B 34/00* | (2006.01) |

(52) U.S. Cl.

CPC ..... *E21B 43/261* (2013.01); *E21B 34/14* (2013.01); *E21B 2034/007* (2013.01)

(58) Field of Classification Search

CPC ..... E21B 34/06; E21B 43/26; E21B 43/261

See application file for complete search history.

(56) References Cited

U.S. PATENT DOCUMENTS

| | | | | |
|---|---|---|---|---|
| 6,672,405 | B2 | 1/2004 | Tolman et al. | |
| 7,387,165 | B2 | 6/2008 | Lopez de Cardenas et al. | |
| 7,516,792 | B2 | 4/2009 | Lonnes et al. | |
| 8,016,032 | B2 | 9/2011 | Mandrell et al. | |
| 2011/0284232 | A1* | 11/2011 | Huang | 166/317 |
| 2012/0067583 | A1 | 3/2012 | Zimmerman et al. | |

OTHER PUBLICATIONS

International Search Report and Written Opinion mailed on Sep. 5, 2013 for International Patent Application No. PCT/US2013/043969, filed on Jun. 4, 2013, 12 pages.

* cited by examiner

*Primary Examiner* — William P Neuder

(74) *Attorney, Agent, or Firm* — Jeffery R. Peterson; Cathy Hewitt

(57) ABSTRACT

A system is provided that is conducive to multi-stage stimulation in a near-continuous fashion. That is, unlike conventional stimulation systems, embodiments herein may operate without the requirement of traditional plug-setting, perforating and fracturing interventions on a zone by zone basis for a cemented completion. Rather, the system is outfitted with frac sleeves that may be shifted open to expose the bore to the formation while simultaneously achieving a seal through a ball drop technique. Once more, this manner of operation is rendered practical by the sleeve being of a passable configuration such that cementing of the casing is not impeded.

15 Claims, 5 Drawing Sheets

CONTINUOUS MULTI-STAGE WELL STIMULATION SYSTEM

PRIORITY CLAIM/CROSS REFERENCE TO RELATED APPLICATIONS

The present document claims priority under 35 U.S.C. §119(e) to U.S. Provisional Patent Application Ser. No. 61/655,126, filed on Jun. 4, 2012 and entitled, "Deployable Multiple Ball Seat System for Continuous Multi-Stage Stimulation", the disclosure of which is incorporated herein by reference in its entirety. The present document also claims priority under 35 U.S.C. §119(e) to U.S. Provisional Patent Application Ser. No. 61/709,642, filed on Oct. 4, 2012 and also entitled, "Deployable Multiple Ball Seat System for Continuous Multi-Stage Stimulation", the disclosure of which is again incorporated herein by reference in its entirety.

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. Over the years, ever increasing well depths and sophisticated architecture have made reductions in time and effort spent in completions and maintenance operations of even greater focus.

Well stimulating applications which include perforating and fracturing of a cased well during completions constitute one such area were significant amounts of time and effort are spent. This is particularly true where increases in well depths and sophisticated architecture are encountered. Once the casing hardware is cemented in place, stimulating applications generally take place in a zone by zone fashion. For example, a terminal end of the well may be perforated and fractured followed by setting of a plug immediately uphole thereof. Thus, with the lowermost zone initially stimulated, the zone above the plug may now also be stimulated by way of repeating the perforating and fracturing applications. This time consuming sequence of plug setting, perforating and then fracturing is repeated for each zone. That is, likely 15-20 zones or more of a given well may be stimulated in this manner. Further, for any given zone, each step of plug setting, perforating and fracturing requires its own dedicated application trip into the well via wireline from surface or other appropriate conveyance.

All in all, where stimulating operations are involved, the operator is likely faced with days' worth of time dedicated to the task. In today's dollars this may translate into several hundred thousand dollars of lost time. Once more, footspace at the surface of the oilfield adjacent the well is taken up by simultaneously competing types of equipment. For example, since each zone requires separate dedicated applications of plugging, perforating and fracturing, all such equipment must remain at the oilfield surface throughout stimulation operations. Thus, so as to be available for later use, frac trucks are left running in place after use in one zone so as to be available for use in the next zone. In fact, this particular inefficiency is often exacerbated where a continuously running but intermittently utilized frac truck breaks down due to repetitive cycles of pumping and powering down to allow for plugging and perforating.

Ultimately, once each zone has been stimulated, the well is left with twenty or so isolated zones. Thus, a milling application may ensue where a milling tool is dropped through the well which mills out all of the plugs. As such, flow through the central bore of the well may be restored. Unlike the previous steps, at least the milling may take place through each zone with only one trip into the well with the milling tool.

Efforts have been undertaken to reduce the overall time and number of trips into the well that result from the zone by zone and stepped nature of stimulation operations. For example, the casing at each zone may be outfitted with a shifting sleeve that also includes a ball seat such that the sleeve may be opened and the wellbore exposed to the surrounding formation. That is, rather than separately introducing perforating and fracturing equipment into the well during separate dedicated trips to each zone, ball actuation may be used to open the sleeves one by one for targeted stimulation. That is to say, a ball of appropriate size may be dropped into the well, eventually finding the seat and sleeve of corresponding size and pressurizably opening that sleeve. The ball and seat may then serve the isolation function and the opened sleeve may obviate the need for perforating. Therefore, stimulation of the zone may take place with only the introduction of fracturing equipment.

In theory the above ball drop technique may save a significant amount of time and trips into the well for sake of stimulation. Unfortunately, such a system renders a host of challenges to the rest of well operations. That is to say, as noted below, applications before and after stimulation are likely to be adversely affected by the use of conventional ball-drop and sleeve shifting hardware.

Conventional ball-drop and sleeve shifting hardware requires fairly complex architecture that is incorporated into the casing and present from the outset of completions. This sophisticated architecture includes the noted sleeve which is likely to present a significant restriction into the main bore of the well. Further, complex mechanical parts such as springs, pressure support mechanisms, ratchets and other features of the ball seat are also likely to protrude into the main bore. Thus, as a practical matter, in spite of the potential time saving benefits, operators are likely to forego ball-drop sleeve shifting stimulation techniques.

SUMMARY

A system is disclosed that is configured to accommodate multi-stage stimulation in a well. The system includes a casing with a frac sleeve that is of a diameter substantially that of the casing so as to support cementing therethrough. Additionally, a ball seat assembly is included for securing at the frac sleeve after the cementing.

DETAILED DESCRIPTION

Embodiments are described with reference to certain types of downhole architecture and applications. For example, embodiments herein focus on a deviated well that is completed and subsequently outfitted with ball seat assemblies via wireline conveyance. However, a variety of different applications and well architecture types may take advantage of passable sleeve and ball seat assemblies as detailed herein. For example, vertical wells may include different regions outfitted with passable sleeve and ball seat assemblies that further cementing and/or allow for near continuous stimulation. Further, alternatives to wireline conveyance may be used, such as coiled tubing. Regardless, embodiments described herein include hardware that supports multi-stage stimulation in a manner that utilizes a frac sleeve and ball seat assembly without substantially compromising effective cementing operations. Thus, the sleeve and/or seat assembly may be referred to herein as passable.

Figure 1:
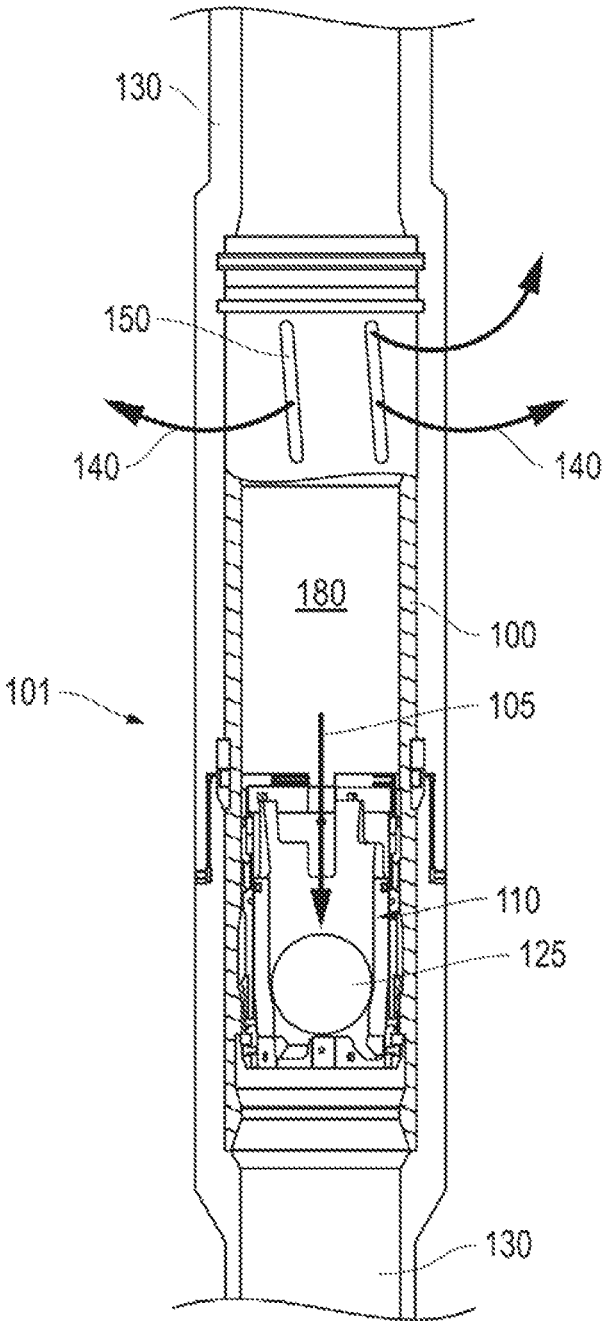
FIG. 1 is a partially sectional view of a casing stimulation region incorporating an embodiment of a passable sleeve and ball seat assembly for fracturing applications.

Referring now to FIG. 1, a partially sectional view of a casing stimulation region 101 is shown. This region 101 is part of a larger, more extensive casing 130 and other hardware that define a well 380 at an oilfield 300 such as that depicted in FIG. 3. In the depiction of FIG. 1, fracturing fluid 140 is shown emerging from slots or side ports 150 in the easing 130. That is, as part of stimulation operations, ultimately directed at promoting the uptake of well fluids, fracturing may take place through the ports 150 as shown. However, such ports 150 are not configured to always be open throughout well operations. Rather, at the outset of operations, such ports 150 are to be closed.

In order to keep the ports 150 closed at the outset of well operations, a frac sleeve 100 is provided that may be slid or shifted to an open position. Indeed, in the depiction of FIG. 1, the sleeve 100 within the main bore 180 of the casing 130 has been shifted downward such that the ports 150 of the casing 130 are now uncovered (see arrow 105). This is achieved by dropping of a ball 125 into the main bore 180 and pumping it through until it reaches a ball seat assembly 110. With added reference to FIG. 2, this assembly 110 includes a seat portion 250 that is of a diameter corresponding to that of the ball 125. Thus, the ball 125 may pass larger diameter seat portions at other stimulation regions 301, 305 of the well 380 without effecting any sleeve shifting thereat (see FIG. 3). In other words, the ball 125 is sized to target a specific seat portion 250 and open a specific sleeve 100 at a specific region 101 for sake of fracturing thereat.

The sleeve 100 described above may be referred to as a passable sleeve 100 that is nearly flush with the casing 130. Indeed, with specific reference now to FIG. 2A, a perspective cross-sectional view of the casing stimulation region 101 of FIG. 1 is shown as it may appear during initial installation of the casing 130. Specifically, at this point in time, the casing 130 is pre-fitted with the passable sleeve 100 covering over the adjacent ports 150. The sleeve 100 may be held in place by a shear element or other conventional mechanism for at least temporary retention. Regardless, the sleeve 100 is passable in the sense that it does not present any significant restriction relative the bore 180. Thus, during completions, as cement is driven through and out the bore 180, no impediment is presented that might otherwise complicate or prevent effective installation of the casing 130.

Figure 2A:
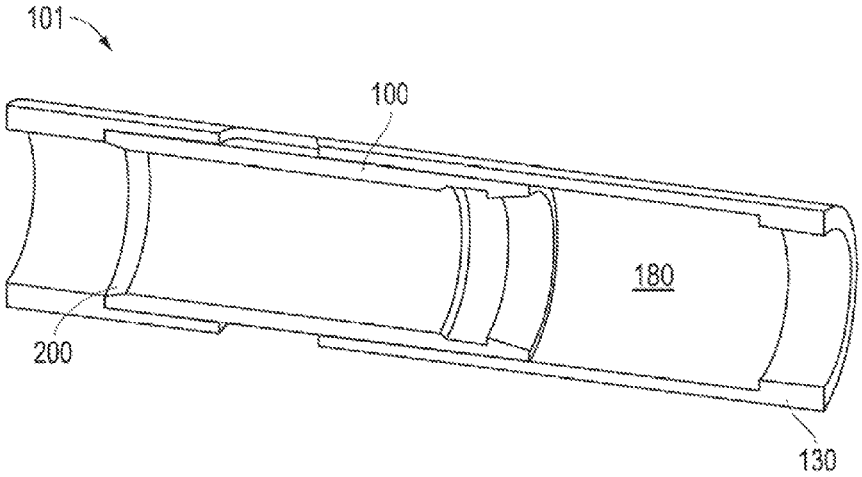
FIG. 2A is a perspective cross-sectional view of the casing stimulation region of FIG. 1 pre-fitted with the passable sleeve.

In the embodiment of FIG. 2A, a tapered portion 200 of the sleeve 100 is provided so as to help further ensure that the sleeve 100 does not present a significant hindrance to cementing as described above. Additionally, the profile of the sleeve 100 is not substantially different from that of the inner diameter of the casing 130. This may be viewed in different ways. For example, in one embodiment the inner diameter of the sleeve 130 may be within about 5%-10% of that of the casing 130. In another embodiment, the inner diameter of the sleeve 100 may be measured as within ½ of an inch of that of the casing 130. Further, with reference to overall dimensions, in one embodiment, the sleeve 100 may be about 4.5 inches at its inner diameter whereas the inner diameter of the adjacent casing 130 is about 4.9 inches.

Figure 2B:
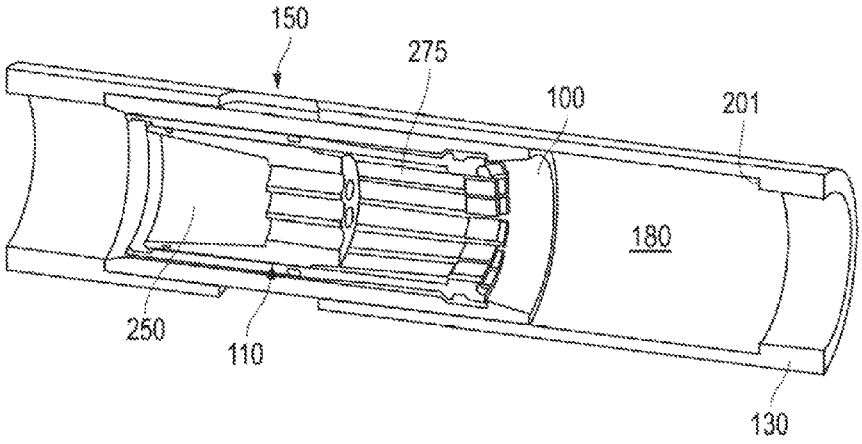
FIG. 2B is a perspective cross-sectional view of the sleeve of the casing stimulation region of FIG. 1 outfitted with the ball seat assembly.

Referring now to FIG. 2B, a perspective cross-sectional view of the sleeve 100 at the casing stimulation region 101 is shown in a manner like that of FIG. 1. Specifically, the sleeve 100 is now outfitted with the ball seat assembly 110. Thus, a ball 125, such as that of FIG. 1, may be advanced to the assembly 110, received by a the seat portion 250, and the sleeve 100 moved toward a stop 201 at the inner diameter of the casing 130. Upon reaching the stop 201, the depicted ports 150 would no longer be covered by the sleeve 100. Therefore, fluid running through the main bore 180 would be sealed off by the ball 125 and directed out the ports 150 (see the fracturing fluid 140 of FIG. 1.).

Continuing with reference to FIG. 2B, with added reference to FIG. 1, the ball seat assembly 110 is made up of two parts, an anchoring portion 275 and the above noted seat portion 250. As referenced above, the seat portion 250 serves as a setting device and is also constructed with a seat for directly interfacing a ball 125 so as to seal off the bore 180 and responsively slide the sleeve 100 downhole. As detailed further below, these parts are delivered together by way of a stepped setting tool 400 (see FIGS. 4A and 4B). In order to attain this delivery, the anchoring, portion 275 may include a landing profile that is tailored for engagement with a particular sleeve 100. More specifically, in the embodiment shown, the anchoring portion 275 is of a collet variety with matching size and profile for engaging with the specific sleeve 100 depicted. However, in another embodiment, a landing profile of the anchoring portion 275 may be constructed for reception by a locating catch 435 of the sleeve 100 for sake of locating the appropriate assembly 110 at the appropriate sleeve 100 (see FIG. 4B).

Once placed, the anchoring portion 275 may be firmly set by shearing away of the seat portion 250 relative the anchoring portion 275 and moving in a downhole direction according to techniques detailed further below. Accordingly, the anchoring portion 275 may become anchored to the casing 130 and serve as a secure support for the seat portion 250. Thus, the seat portion 250 may be reinforced as an effective seal when the seat thereof receives a ball 125 as shown in FIG. 1. In one embodiment, the seat portion 250 internally tapers down to a diameter of between about 0.7 and 6.5 inches to serve as the ball seat when receiving a ball 125 of slightly larger diameter. As a practical matter, this means that for the seat portion 250 of other ball seat assemblies installed further uphole in the well, a larger diameter seat and ball 125 will be utilized. That is, to ensure passage to the most downhole seat, a comparatively small ball 125 dropped from at oilfield surface 300 will need to attain passage through all other seats before reaching the most downhole seat/setting portion 250. Otherwise, a premature engagement and sealing with another seat further uphole may take place, thereby preventing sleeve actuation at a location further downhole.

Figure 3:
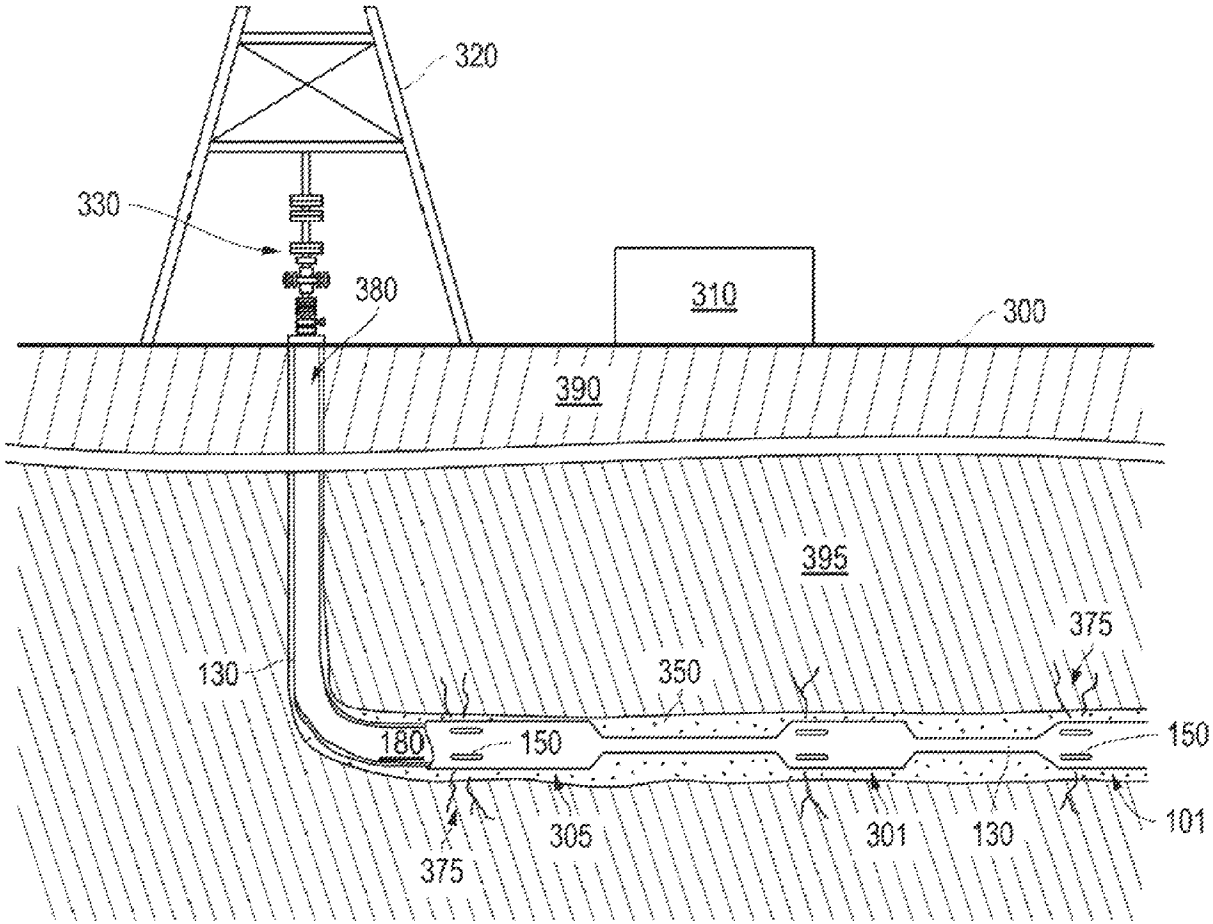
FIG. 3 is an overview of an oilfield with a cased well accommodating the stimulation region of FIG. 1.

Referring now to FIG. 3, an overview of an oilfield 300 is shown. A conventional rig 320 and pressure control equipment 330 are provided. Additionally, a deviated cased well 380 is depicted which accommodates the stimulation region 101 of FIG. 1 along with other such regions (301, 305). Indeed, the well 380 traverses different formation layers 390, 395 and may include 15-20 or more different stimulation regions such as those depicted. However, as indicated above, the process of fracturing regions 101, 301, 305 such as these no longer requires that each region include a series of separate dedicated plugging and perforating interventions. Rather, a ball is dropped, a sleeve opened to expose ports 150 and the formation 395 adjacent a region 101 is stimulated by fracturing fluid at up to about 10,000 PSI. The result is shown in FIG. 3 as formation cracks 375 adjacent the first region 101. Subsequently, a slightly larger ball is dropped, and the same process repeated at another region 301 and then at yet another region 305 (again, with an incrementally larger ball).

The above described manner of sequentially fracturing or "fracing" the formation 395 adjacent the various regions 101, 301, 305 is achieved in an efficient manner. For example, not only is the need for a multitude of dedicated interventional trips into the well 380 avoided, but this is done in a manner that allows frac pumps 310 to flirt nearly continuously. That is, fracturing requires the use of pumps 310. They may be provided by way of frac trucks or on a skid or other less mobile form. In FIG. 3, they are depicted schematically in block form at the oilfield surface 300. Regardless, operational efficiency of such high pressure inducing pumps is best attained when the pumps 310 are running and pumping at a significant rate. To the contrary, where repeated extended downtime is encountered for plug setting and/or perforating applications, the pumps 310 are more prone to inefficient operation or even breakdown. However, in the embodiment of FIG. 3, such significant downtime is not required. Rather, brief pumping pauses for sake of dropping one ball or another into the well 380 from the oilfield surface 300 is all that is necessary. The remainder of the time, the pumps 310 may function at the desired capacity and efficiency as determined by the operator.

In addition to the efficiency of nearly continuous multi-stage stimulation that is provided by the overall system, the casing 130 and other hardware has also been installed in a practical and efficient manner. That is, with added reference to FIG. 2A, the overall morphology of the internal sleeves 100 is such that the casing 130 may be cemented in place without undue obstruction to the main bore 180. Rather, the cement 350 may pass through the entirety of the bore 180 and emerge outside the casing 130 to complete the installation process (see cement 350).

Additional post-fracturing efficiencies are also provided via the system of FIG. 3. For example, the balls may be of a degradable or dissolvable form such that intervention for sake of restoring flow through the bore 180 may be avoided. In another embodiment, techniques may be employed to flow the balls back to surface.

Figure 4A:
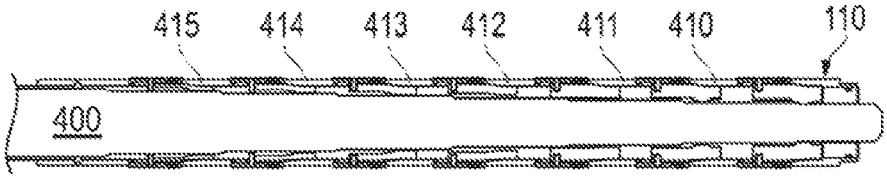
FIG. 4A is as side partially sectional view of a stepped actuator delivery tool for placement of ball seat assemblies at sleeves of casing stimulation regions.
Figure 4B:
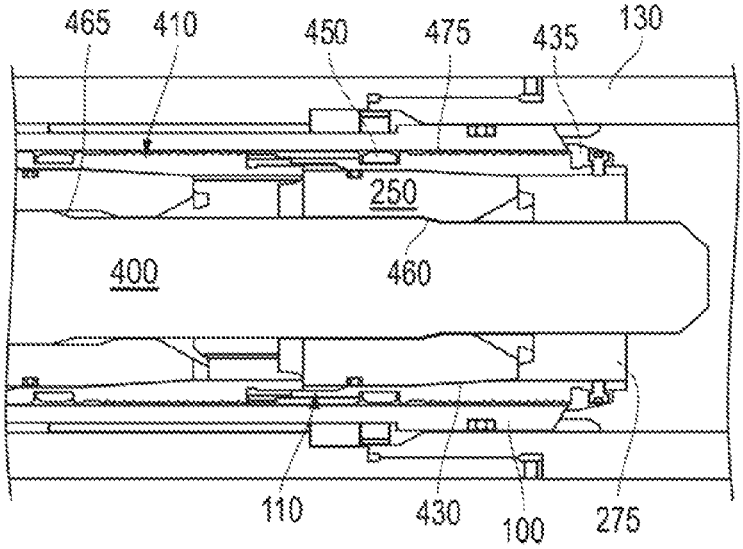
FIG. 4B is a side partially sectional view of the tool of FIG. 4A delivering the ball seat assembly to the sleeve of FIG. 1.
Figure 4C:
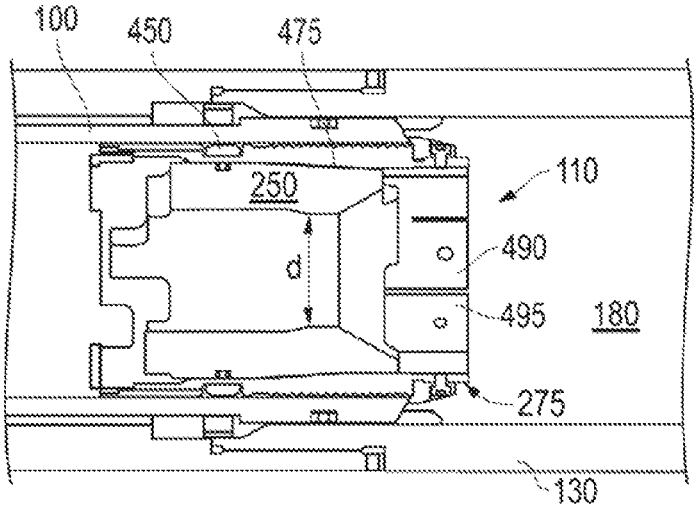
FIG. 4C is a side partially sectional view of the ball seat assembly of FIG. 4B actuated into set engagement with the sleeve.

Referring now to FIGS. 4A-4C, the manner of installation of the ball seat assembly 110 at the sleeve 100 is described in greater detail. More specifically, FIG. 4A is a side partially sectional view of a stepped actuator delivery tool 400 for delivery of the ball seat assembly 110 along with many others (410-415). FIG. 4B depicts the specific delivery of the assembly 110 to the sleeve 100 of FIG. 1 and FIG. 4C reveals the anchored setting of the assembly 100 at the sleeve 100.

With specific reference to FIG. 4A, the embodiment of the delivery tool 400 shown accommodates seven different ball seat assemblies 110, 410-415 in a stacked fashion. Thus, with added reference to FIGS. 1 and 3, following cementing of casing 130, a single run of the tool 400 into the well may be used to place assemblies 110, 410-415 at up to seven different fracturing regions 101, 301, 305. So, for example, in a well with 20 different regions, three different trips into the well 380 would be sufficient for fully outfitting each sleeve 100 at each region 101 with a ball seat assembly 110.

With specific reference to FIG. 4B, a side partially sectional view of the tool 400 of FIG. 4A is shown in which the ball seat assembly 110 is delivered to the sleeve 100 of FIG. 1. The anchoring portion 275 of the assembly 110 is of a matching profile to that of the sleeve 100. For example, with added reference to FIGS. 1 and 3, in one embodiment, the tool 400 bypasses all regions 101, 301, 305 of the well 380 and is then retracted back uphole. Upon reaching the first region 101 during the retraction, the matching profile of the assembly 110 will interlock with the sleeve 100 as shown in FIG. 4B.

With the assembly 110 in place, the tool 400 may be shifted downhole such that a first step 460 engages with the seat of the seat portion 250 of the assembly 110. Thus, the seat portion 250 may sheared from its initial position and begin to shift downhole over an incline 430 of the anchoring portion 275. Ultimately, as discussed further below, this may result in "wickets" or teeth 475 of the anchoring portion 275 biting into the sleeve 100 and securely retaining of the entire assembly 100 in place.

It is of note that the movement of the tool 400 in order to set the first assembly 110 does not affect setting of the next assembly 410. That is, the second step 465 of the tool 400 is distanced far enough from the seat of the second assembly 410 that it does not unintentionally begin to set the second assembly 410. Rather, following setting of the first assembly 110, the tool 400 is removed further uphole, taking the second assembly 410 and leaving the first assembly 110 in place.

Referring now to FIG. 4C, a side partially sectional view of the ball seat assembly 110 of FIG. 4B is shown now that it is fully actuated into set engagement with the sleeve 100. With the tool 400 of FIG. 4B removed, the fully anchored assembly 110 is shown in place. As indicated above, the anchoring portion 275 is of a collet-type. Thus, as the seat portion 250 was shifted downhole, separate fingers 490, 495 of the anchoring portion 275 spread apart relative one another allowing the teeth 475 to come into full securing engagement with the sleeve 100. Similarly, a rubber seal 450 has been energized into sealing engagement with the sleeve 100 such that the anchoring is both secure and sealed. The seat portion 250 is now poised for responsive reception of a ball having a diameter that is slightly above that of the seat (see diameter (d)). Once more, all of this installation is complete before any fracturing is begun. Thus, no interventional interruption of stimulation is necessary in order to achieve a sealing off of the bore 180 or for exposing of the adjacent formation.

Figure 5:
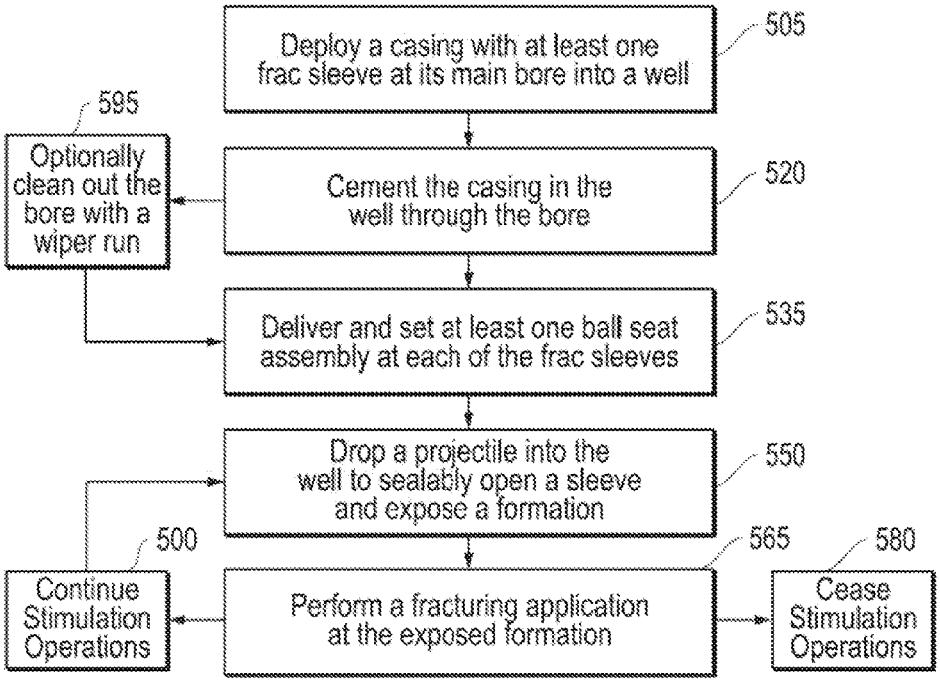
FIG. 5 is a flow chart summarizing an embodiment of carrying out near continuous multi-stage well stimulation operations in a manner taking advantage of passable sleeve and ball seat assembly hardware.

Referring now to FIG. 5, a now chart is shown summarizing an embodiment of carrying out near continuous multi-stage well stimulation operations. Specifically note that a 'projectile' or ball may be dropped to open a sleeve as indicated at 550, a fracturing application undertaken as indicated at 565 and the process repeated (see 500) or terminated (see 580). That is, while the chart summarizes one particular ball drop and fracturing, the overall system is such that multi-stage stimulation may be undertaken merely by dropping another ball (550) and fracturing (565) at another location for as many times as necessary, as detailed hereinabove. Thus, the overall system may be referred to as supporting near continuous multi-stage stimulation with the only interruptions being brief pauses for the sake of dropping in another sized ball/projectile.

Continuing with reference to FIG. 5, the practicality of the system is furthered by the use of a passable frac sleeve. That is, as indicated at 505, a casing may be pre-fitted with one or more frac sleeves within the main bore that nevertheless allow for cementing through the main bore (see 520). As indicated at 595, this may or may not be followed by a clean out run, for example, with a conventional wiper. Regardless, once the installation and cementing are complete, ball seat assemblies may be delivered and set as indicated at 535. Thus, a repeatable ball drop stimulation technique may be undertaken as described above (see 550, 565, 500).

Embodiments described hereinabove provide hardware and techniques that effectively reduce the number of trips into the well in order to perform multi-stage stimulation. Specifically, this is achieved via ball drop technique and hardware that allows for avoiding plug setting and perforating application trips separately directed at each zone. As a result, near continuous stimulation may be achieved without significant intervening disruption. Once more, this is achieved in a manner that avoids presenting any substantial obstructions to the main bore. Thus, effective cementing of the casing hardware is not sacrificed and follow-on intervention after stimulation is not materially impeded.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A system to accommodate multi-stage stimulation in a well, the system having a casing stimulation region comprising:

casing defining a bore therethrough;

a pre-fitted passable sleeve within the casing to accommodate cementing through the bore; and a seat assembly for securing at said sleeve following the cementing and prior to a fracturing application a linear stepped actuator and delivery tool to deliver said seat assembly to said sleeve, wherein the casing stimulation region is one of a plurality of casing stimulation regions and said seat assembly is one of a plurality of seat assemblies, said stepped tool accommodating a stacked plurality of seat assemblies for the delivery thereof to multiple stimulation regions on a single run into the well.

2. The system of claim 1 wherein said sleeve includes an inner diameter that is within about 10% of an inner diameter of the casing.

3. The system of claim 1 wherein said sleeve is a frac sleeve for covering at least one side port in said casing during the cementing.

4. The system of claim 3 wherein said seat assembly comprises a seat for receiving a projectile to seal the bore and pressurizably shift said sleeve and expose a formation to the bore through the port.

5. The system of claim 4 wherein the projectile is a ball having a diameter corresponding to that of said seat.

6. The system of claim 5 wherein the diameter is between about 0.7 inches and about 6.5 inches.

7. The system of claim 5 wherein the ball is one of degradable and dissolvable.

8. The system of claim 1 wherein said seat assembly comprises:

an anchoring portion for securing said assembly to said sleeve; and a seat portion to serve as a setting device for the securing.

9. The system of claim 8 wherein said anchoring portion comprises a landing profile matching a locating catch of said sleeve to locate said assembly thereat.

10. A method of employing a multi-stage well stimulation system, the method comprising:

deploying a casing into a well with a passable sleeve at a main bore thereof;

cementing the casing in the well through the bore;

securing a plurality of seat assemblies at selected longitudinal positions along an inner surface of the sleeve after said cementing in a single intervention operation;

dropping a projectile into the well to sealably interface one of the plurality of seat assemblies and pressurizably open the sleeve for exposure of the bore to an adjacent formation; and fracturing the adjacent formation with a fracturing fluid through the bore.

11. The method of claim 10 wherein the projectile is a first projectile of a given diameter, said fracturing is supported by a frac pump positioned at an oilfield adjacent the well, and the method further comprises:

leaving the pump in near-continuous operation;

dropping another projectile of another diameter that exceeds the given diameter into the well to sealably interface another seat assembly of the plurality of seat assemblies and open another sleeve for exposure of the bore to the adjacent formation at another location thereof; and fracturing the adjacent formation at the other location with the fracturing fluid through the bore.

12. The method of claim 10 further comprising removing the projectile from the one of the plurality of seat assemblies, said removing comprising one of dissolving the projectile, degrading the projectile, milling out the projectile and fluidly flowing the projectile up out of the well.

13. A method of completing a multi-stage well stimulation system, the method comprising:

deploying a casing into a well with a pre-fitted sleeve at an inner surface of the casing defining a main bore of the well;

cementing the casing in the well through the bore;

running a delivery tool into the well with a seat assembly thereon after said cementing;

matching a profile of an anchoring portion of the assembly with the sleeve to deliver the assembly thereto;

advancing a seat portion of the assembly toward the anchoring portion for securing the assembly to the sleeve; and withdrawing the tool from the sleeve to complete installation of the assembly;

wherein the pre-fitted sleeve is one of a plurality of pre-fitted sleeves of the casing and the seat assembly is one of a plurality of seat assemblies stacked on the delivery tool, the delivery tool being a linear stepped actuator and delivery tool, and the method further comprising:

locating another seat assembly of the plurality on the tool adjacent another sleeve of the plurality of the casing;

matching a profile of an anchoring portion of the other assembly with the other sleeve to deliver the other assembly thereto;

advancing a seat portion of the other assembly toward the anchoring portion for securing the other assembly to the other sleeve; and withdrawing the tool from the other sleeve to complete installation of the other assembly.

14. The method of claim 13 wherein said advancing of the seat portion comprises spreading apart separate fingers of the anchoring portion to force teeth thereof into biting engagement with the sleeve.

15. The method of claim 13 wherein said advancing further comprises energizing a seal of the anchoring portion into sealable engagement with the sleeve.

* * * * *